US008870337B1

(12) United States Patent
Jensen et al.

(10) Patent No.: US 8,870,337 B1
(45) Date of Patent: Oct. 28, 2014

(54) PRINTHEAD DIE WITH DAMAGE DETECTION CONDUCTOR BETWEEN MULTIPLE TERMINATION RINGS

(71) Applicant: Hewlett-Packard Development Company, L.P., Houston, TX (US)

(72) Inventors: Kellie S. Jensen, Corvallis, OR (US); Rio Rivas, Corvallis, OR (US); Anthony M. Fuller, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 73 days.

(21) Appl. No.: 13/872,314

(22) Filed: Apr. 29, 2013

(51) Int. Cl.
*B41J 29/393* (2006.01)
*B41J 2/01* (2006.01)
*B41J 29/00* (2006.01)

(52) U.S. Cl.
CPC ... *B41J 2/01* (2013.01); *B41J 29/00* (2013.01)
USPC ..... 347/19

(58) Field of Classification Search
USPC ..... 347/19, 42, 47, 49
See application file for complete search history.

(56) References Cited

U.S. PATENT DOCUMENTS

| | | | | |
|---|---|---|---|---|
| 5,363,134 | A * | 11/1994 | Barbehenn et al. | 347/49 |
| 5,504,507 | A * | 4/1996 | Watrobski et al. | 347/19 |
| 5,736,997 | A * | 4/1998 | Bolash et al. | 347/19 |
| 5,942,900 | A | 8/1999 | DeMeerleer et al. | |
| 2012/0286269 | A1 | 11/2012 | Hemon et al. | |
| 2012/0318925 | A1 | 12/2012 | Gibson et al. | |
| 2013/0009663 | A1 | 1/2013 | Gauch et al. | |
| 2013/0043888 | A1 | 2/2013 | Soar | |

OTHER PUBLICATIONS

Stanely E. Woodard et al.; A Method to Have Multi-Layer Thermal Instulation Provide Damage Detection; American Insitute of Aeronautics and Astronautics; Apr. 23-26, 2007; pp. 1-23.

* cited by examiner

*Primary Examiner* — Kristal Feggins

(57) ABSTRACT

In one example implementation, a printhead die includes a SiO2 layer grown into a surface of a silicon substrate, a dielectric layer formed on the surface over an interior area of the substrate, a first termination ring surrounding the interior area and defined by an absence of the dielectric layer, a berm surrounding the first termination ring and defined by the presence of the dielectric layer, a damage detection conductor formed under the berm on the SiO2 layer, and a second termination ring surrounding the berm and defined by an absence of the dielectric layer.

17 Claims, 13 Drawing Sheets

PRINTHEAD DIE WITH DAMAGE DETECTION CONDUCTOR BETWEEN MULTIPLE TERMINATION RINGS

BACKGROUND

An inkjet printhead is a microfluidic device that includes an electronic circuit on a silicon substrate and an ink firing chamber defined by an ink barrier and an orifice, or nozzle. Various microfabrication techniques used for fabricating semiconductors are also used in the fabrication of printheads. For example, many functional printhead chips, or dies, are fabricated together on a single silicon wafer. The functional printhead dies are then separated from the wafer, or singulated, using a saw blade to cut the wafer along the thin, non-functional spacing between each die (i.e., the saw street). As the saw blade moves along the saw street, it makes a kerf, or slit in the wafer at the edges of individual dies. The saw blade often causes chipping to occur along the kerf that can result in damaged and defective printhead dies. Die handling equipment, such as a die bonder tool used during singulation and subsequent manufacturing processes can also cause damage along the kerf or die edges. Normal use of the printhead die can cause or increase such damage as well. Damage to printhead die edges reduces the percentage yields in printhead fabrication and increases replacement costs when defects are discovered during printing. Accordingly, efforts to improve detection of this damage and mitigate its impact are ongoing.

BRIEF DESCRIPTION OF THE DRAWINGS

The present embodiments will now be described, by way of example, with reference to the accompanying drawings, in which.

DETAILED DESCRIPTION

Overview

Figure 1A:
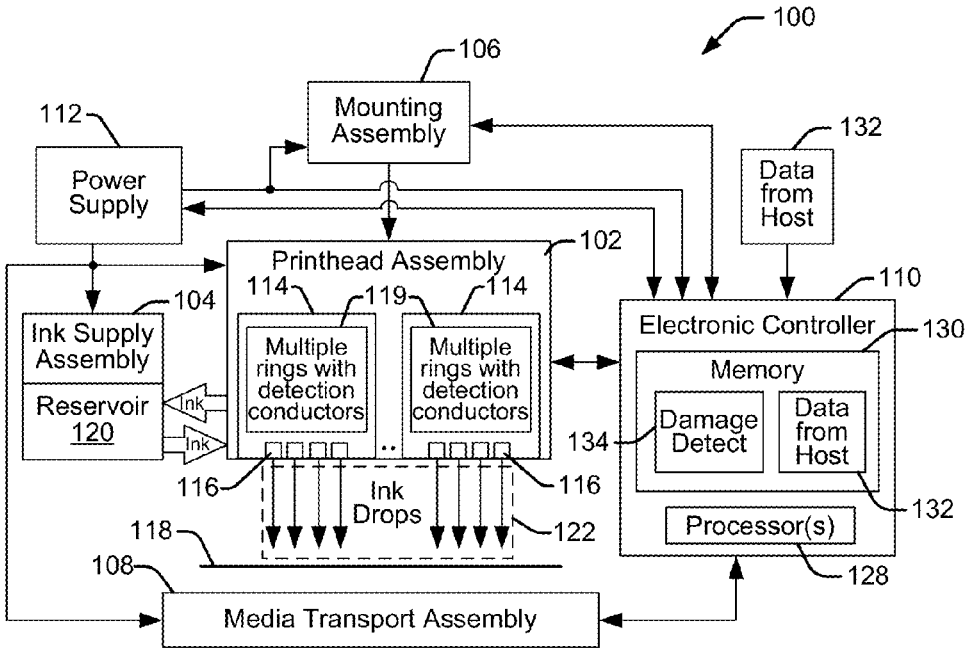
FIG. 1*a* illustrates a fluid ejection system implemented as an inkjet printing system, according to an example implementation.

As noted above, kerf chipping from saw blades, bonding equipment, and normal use, can lead to defective and/or damaged printhead dies and reduced fabrication yields for printheads. Accordingly, efforts to provide cost-effective detection and mitigation of kerf chip damage are ongoing. Kerf chips can occur in both the silicon substrate and the thin-film layer formed on the substrate of a die. The extent to which a printhead die may be at risk of failure can depend on how far a kerf chip propagates toward and/or into the functional area of the die, which can typically be determined upon visual inspection. Kerf chipping can also lead to cracks that extend into the silicon substrate and the thin-film and fluidic layers fabricated on the substrate of a printhead die. In some cases, such cracks can propagate into the functional area of a printhead die, causing electrical and other failures in the die.

Printhead dies are generally less tolerant of damage from kerf chipping and cracking than conventional semiconductor integrated circuit dies, due to the constant exposure of printhead dies to the corrosive effects of ink. A kerf chip that exposes the thin-films near the functional edge of a conventional semiconductor die may be tolerable because the die is typically covered in epoxy and/or otherwise packaged in a manner that prevents the kerf chip from causing a failure. However, a kerf chip that causes similar exposure to the thin-films near the functional edge of a printhead die will usually render the printhead die defective, because the functioning printhead die is in direct and constant contact with ink. The ink attacks and corrodes the thin-films and can lead to electrical failure of the printhead die if the kerf chip causes exposure of the thin-films too close to the functional edge of the die.

Efforts to produce more robust and reliable printhead die-edge terminations are ongoing. Previous approaches for reducing die defects from saw kerf chipping include making the width of the saw street much greater than the width of the saw blade. This solution typically results in highly reliable printhead dies, because saw blade kerf chips do not come close enough to the functional thin-film terminations along the edges of the dies to cause defective parts. One drawback to using wide saw streets, however, is that it involves the use of additional real estate on the wafer which results in a lower separation ratio (i.e., lower die per wafer) and higher costs.

Some conventional semiconductor dies include a protection ring formed around the die to help prevent the propagation of cracks into the inner, functional, region of the die. However, the protection ring in such semiconductor dies is formed in the layers above the die substrate and therefore provides little or no protection for the substrate itself. As a result, cracks often propagate into the functional region of the die through cracks that travel through the unprotected substrate. Furthermore, due to the corrosive ink environment in which printhead dies operate, a semiconductor die protection ring implemented in a printhead die is ineffective in preventing die failures from kerf chips. As noted above, a kerf chip that is terminated at the functional edge of a printhead die usually results in failure of the die because of the direct and continual exposure of the thin-films to ink at the functional edge of the die, which attacks and corrodes the thin-films, leading to electrical failure of a printhead die.

Damage from kerf chipping in printhead dies is generally detected using random visual inspections of die samples during or directly following die fabrication. However, visually inspecting samples of printhead dies is insufficient as it does not adequately detect damage to dies that are not part of the sampled group, and some damage such as hairline cracks may not be visible. In addition, visual inspection is time consuming and costly.

Embodiments of the present disclosure improve on prior efforts to detect and prevent defective printhead dies caused by kerf chipping, generally by providing damage detection conductors nestled between multiple damage termination rings. The termination rings comprise a field oxide (i.e., FOX) layer of silicon dioxide (SiO2) grown into the surface of a silicon substrate. Because the SiO2 layer is a grown oxide layer, as opposed to being a deposited layer (e.g., by CVD, chemical vapor deposition), it provides greater integrity and higher strength to the silicon substrate and helps prevent kerf chips and cracks from propagating through the substrate. The termination rings are concentric around the inner, functional area of the die, for example, with a first ring adjacent to the functional edge of the die and a second ring outside of the first ring. Additional termination rings can be formed concentrically around the second termination ring. Berms comprising a layer of TEOS and BPSG separate the first and second termination rings, as well as any additional termination rings outside the second ring. Together, a first ring, a berm, and a second ring provide three kerf chip break points or barriers. The kerf chip barriers help to dissipate the energy in kerf chips and prevent the kerf chips from propagating further inward toward the functional area of the printhead die. A damage detection conductor runs underneath each of the one or more berms. Multiple damage detection conductors between concentric termination rings enable a printer to gather graduated damage data that indicates different levels of damage to a printhead die, as well as whether the die is defective.

In one example, a printhead die includes a silicon dioxide (SiO2) layer grown into the surface of a silicon substrate. A dielectric layer is formed on the surface of the substrate, and covers an interior functional area of the substrate. A first termination ring surrounds the interior area and is defined by an absence of the dielectric layer. A berm surrounds the first termination ring and is defined by the presence of the dielectric layer. A damage detection conductor is formed under the berm and on top of the SiO2 layer. A second termination ring then surrounds the berm and is also defined by an absence of the dielectric layer over.

In another example, a printhead die includes a SiO2 layer grown into a surface of a silicon substrate, a dielectric layer deposited onto an interior surface area of the substrate, multiple termination rings formed concentrically around the interior surface area, each ring defined by an absence of the dielectric layer, a berm in between every set of two termination rings, each berm defined by the presence of the dielectric layer, and a damage detection conductor formed on the SiO2 layer under each berm.

In another example, a processor-readable medium stores code representing instructions that when executed by a processor cause the processor to apply a voltage to a first conductor on a printhead die to determine if there is damage to the printhead die past a first level. When there is damage past a first level, the processor applies a voltage to a second conductor on the printhead die to determine if there is damage to the printhead die past a second level. When there is damage past the first level but not the second level, the processor reports that the printhead die is damaged but is not defective, and when there is damage past the first and second levels, the processor reports that the printhead die is damaged and may be defective.

Illustrative Embodiments

FIG. 1*a* illustrates a fluid ejection system implemented as an inkjet printing system 100, according to an example implementation. Inkjet printing system 100 generally includes an inkjet printhead assembly 102, an ink supply assembly 104, a mounting assembly 106, a media transport assembly 108, an electronic controller 110, and at least one power supply 112 that provides power to the various electrical components of inkjet printing system 100. In this embodiment, fluid ejection devices 114 are implemented as fluid drop jetting printhead dies 114 (i.e., inkjet printhead dies 114). Inkjet printhead assembly 102 includes at least one fluid drop jetting printhead die 114 that ejects drops of ink through a plurality of orifices or nozzles 116 toward print media 118 so as to print onto the print media 118. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other. Print media 118 can be any type of suitable sheet or roll material, such as paper, card stock, transparencies, Mylar, and the like. As discussed further below, each printhead die 114 comprises multiple termination rings 119 and a damage detection conductor 119 running underneath berms that separate the rings. The rings, berms, and conductors surround a functional interior area of the die to detect kerf chip damage and prevent the damage from propagating into the function interior area, thus protecting the die from attack at its edges by corrosive inks.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a macro-recirculating ink delivery system. In a one-way ink delivery system, substantially all of the ink supplied to inkjet printhead assembly 102 is consumed during printing. In a macro-recirculating ink delivery system, however, only a portion of the ink supplied to printhead assembly 102 is consumed during printing. Ink not consumed during printing is returned to ink supply assembly 104.

Figure 1B:
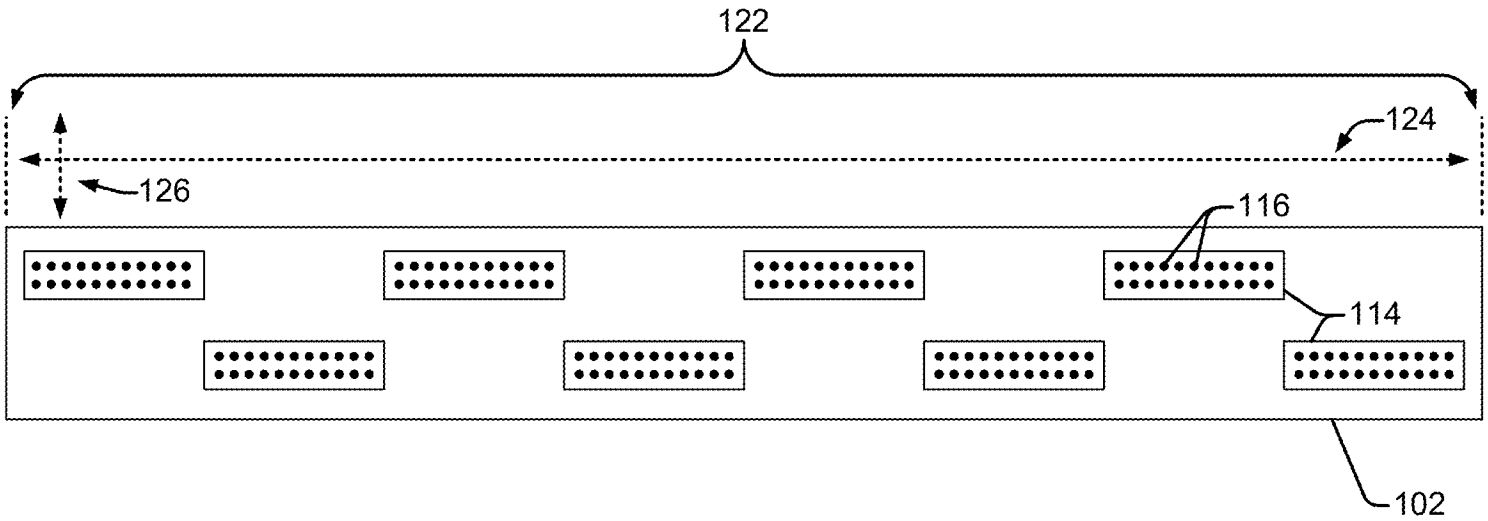
FIG. 1*b* shows an example inkjet printhead assembly implemented as an inkjet printbar, according to an example implementation.

In some implementations, as shown in FIG. 1*b*, inkjet printhead assembly 102 comprises an inkjet printbar 102 having multiple printhead dies 114 arranged in staggered rows. In this case, the ink supply assembly 104 is typically separate from the inkjet printbar 102 and supplies ink to the printbar 102 through an interface connection, such as a supply tube. The reservoir 120 of ink supply assembly 104 can be removed, replaced, and/or refilled. The printbar 102 and multiple dies 114 extend across the width 124 of a printzone 122 such that print media 118 can move past the multiple dies 114 and nozzles 116 in a perpendicular direction 126 with respect to the width 124 of the printzone 122. Accordingly, in this implementation, the printing system 100 can be referred to as a page-wide array (PWA) printer having a fixed or stationary printhead bar 102. In other implementations, printing system 100 can be configured as a scanning type inkjet printing device implementing one or more integrated inkjet cartridges or pens. An integrated inkjet cartridge houses both the inkjet printhead assembly 102 and ink supply assembly 104 in a replaceable unit that typically includes a single printhead die 114.

Mounting assembly 106 positions inkjet printhead assembly 102 relative to media transport assembly 108, and media transport assembly 108 positions print media 118 relative to inkjet printhead assembly 102. Thus, print zone 122 is defined adjacent to nozzles 116 in an area between the inkjet printhead assembly 102 and print media 118. In a PWA printer where the printhead assembly 102 comprises a printbar 102, mounting assembly 106 fixes the printbar 102 at a prescribed position while media transport assembly 108 positions and moves print media 118 relative to the printbar 102. In a scanning type printer where the printhead assembly 102 comprises one or more inkjet cartridges 102, the mounting assembly 106 includes a carriage for moving the cartridges 102 relative to the media transport assembly 108 to scan print media 118.

In one implementation, inkjet printing system 100 is a drop-on-demand thermal bubble inkjet printing system comprising a thermal inkjet (TIJ) printhead die. The TIJ printhead die implements a thermal resistor ejection element in an ink chamber to vaporize ink and create bubbles that force ink or other fluid drops out of a nozzle 116. In another implementation, inkjet printing system 100 is a drop-on-demand piezoelectric inkjet printing system where a printhead die 114 is a piezoelectric inkjet (PIJ) printhead die that implements a piezoelectric material actuator as an ejection element to generate pressure pulses that force ink drops out of a nozzle.

Electronic controller 110 typically includes one or more processors 128, firmware, software, one or more computer/processor-readable memory components 130 including volatile and non-volatile memory components (i.e., non-transitory tangible media), and other printer electronics for communicating with and controlling inkjet printhead assembly 102, mounting assembly 106, and media transport assembly 108. Electronic controller 110 receives data 132 from a host system, such as a computer, and temporarily stores data 132 in memory 130. Typically, data 132 is sent to inkjet printing system 100 along an electronic, infrared, optical, or other information transfer path. Data 132 represents, for example, a document and/or file to be printed. As such, data 132 forms a print job for inkjet printing system 100 and includes one or more print job commands and/or command parameters.

In one implementation, electronic controller 110 controls inkjet printhead assembly 102 to eject ink drops from nozzles 116. Thus, electronic controller 110 defines a pattern of ejected ink drops that form characters, symbols, and/or other graphics or images on print media 118. The pattern of ejected ink drops is determined by the print job commands and/or command parameters within data 132. In another implementation, as discussed in more detail below, memory 130 includes a damage detection module 134 executable on electronic controller 110 (i.e., processor 128) to detect open circuits in one or more damage detection conductors on a printhead die 114 and determine varying levels of damage and or defectiveness within the die 114 based on the detections.

Figure 2:
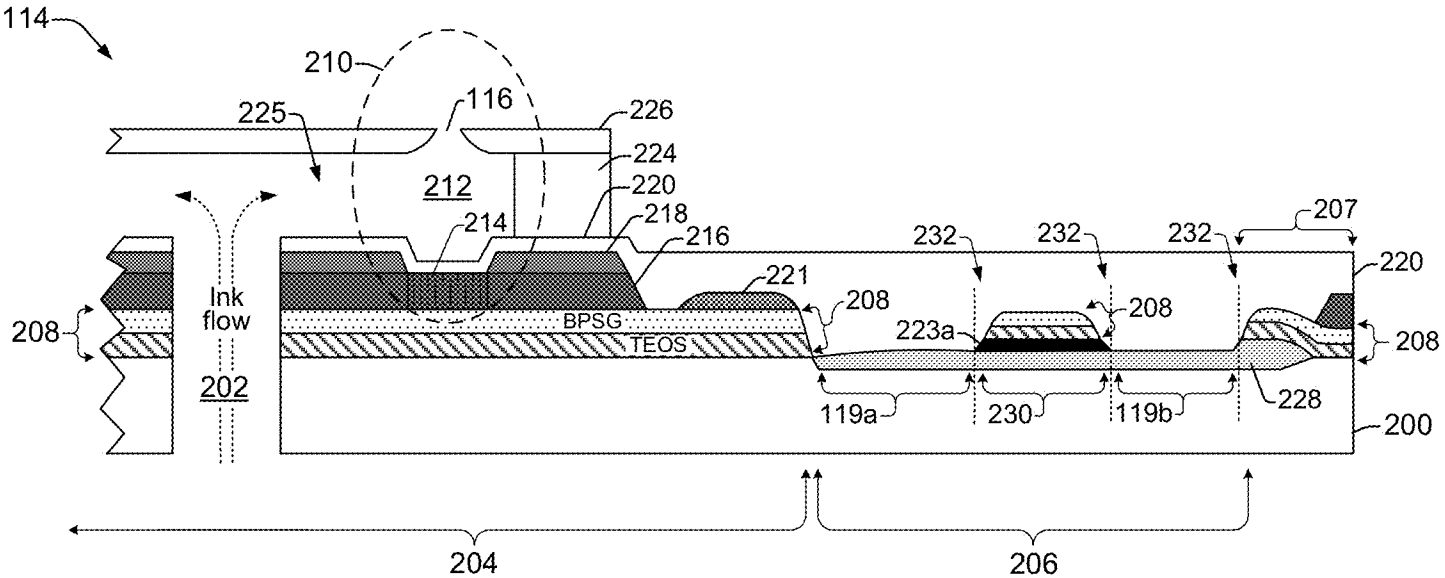
FIG. 2 shows a cross-sectional view of a portion of an example printhead die, according to an example implementation.

FIG. 2 shows a cross-sectional view of a portion of a printhead die 114, according to an example implementation. The portion of the printhead die 114 shown in FIG. 2 generally illustrates the right side of the die. The left side of the die 114 is not shown, but would be a mirror image of the right side. A printhead die 114 is formed in part, of a layered architecture that includes a substrate 200 (e.g., silicon) with a fluid slot 202 or trench formed therein, and various thin-film layers such as a conductive metal layer, a resistive layer, a dielectric layer, a passivation layer, and other layers. It should be noted that the features and layers of the printhead die 114 shown in FIGS. 2-11 are not intended to be drawn to scale. Thus, a particular layer in FIG. 2 may appear to be thicker than it should when compared to the appearance of another layer in FIG. 2. Furthermore, the features and layers of the printhead die 114 shown and discussed in FIGS. 2-11 are not intended to represent an exhaustive list of features and layers that might be present in a given printhead die 114. Accordingly, a given printhead die 114 may include additional features and layers (e.g., a bond pad layer and an adhesive layer) that are not shown in FIGS. 2-11.

In general, the features and layers of the printhead die 114 can be formed using various precision microfabrication techniques such as thermal oxidation, electroforming, laser ablation, sputtering, spin coating, physical vapor deposition (PVD), chemical vapor deposition (CVD), electrochemical deposition (ECD), etching, photolithography, casting, molding, stamping, machining, and the like. Photolithography and masks can be used to pattern layers by protecting and/or exposing the patterns to etching, which removes material from the patterned layers. Etching can be isotropic or anisotropic, and can be performed using various etching techniques such as wet etching, dry etching, chemical-mechanical planarization (CMP), reactive-ion etching (RIE), and deep reactive-ion etching (DRIE). Features of a printhead die 114 resulting from the deposition, patterning, and etching of layers can include resistors, capacitors, sensors, wires, ink chambers, fluid flow channels, contact pads, and conductor traces that can connect the resistors and other electrical components and circuitry together.

Figure 3:
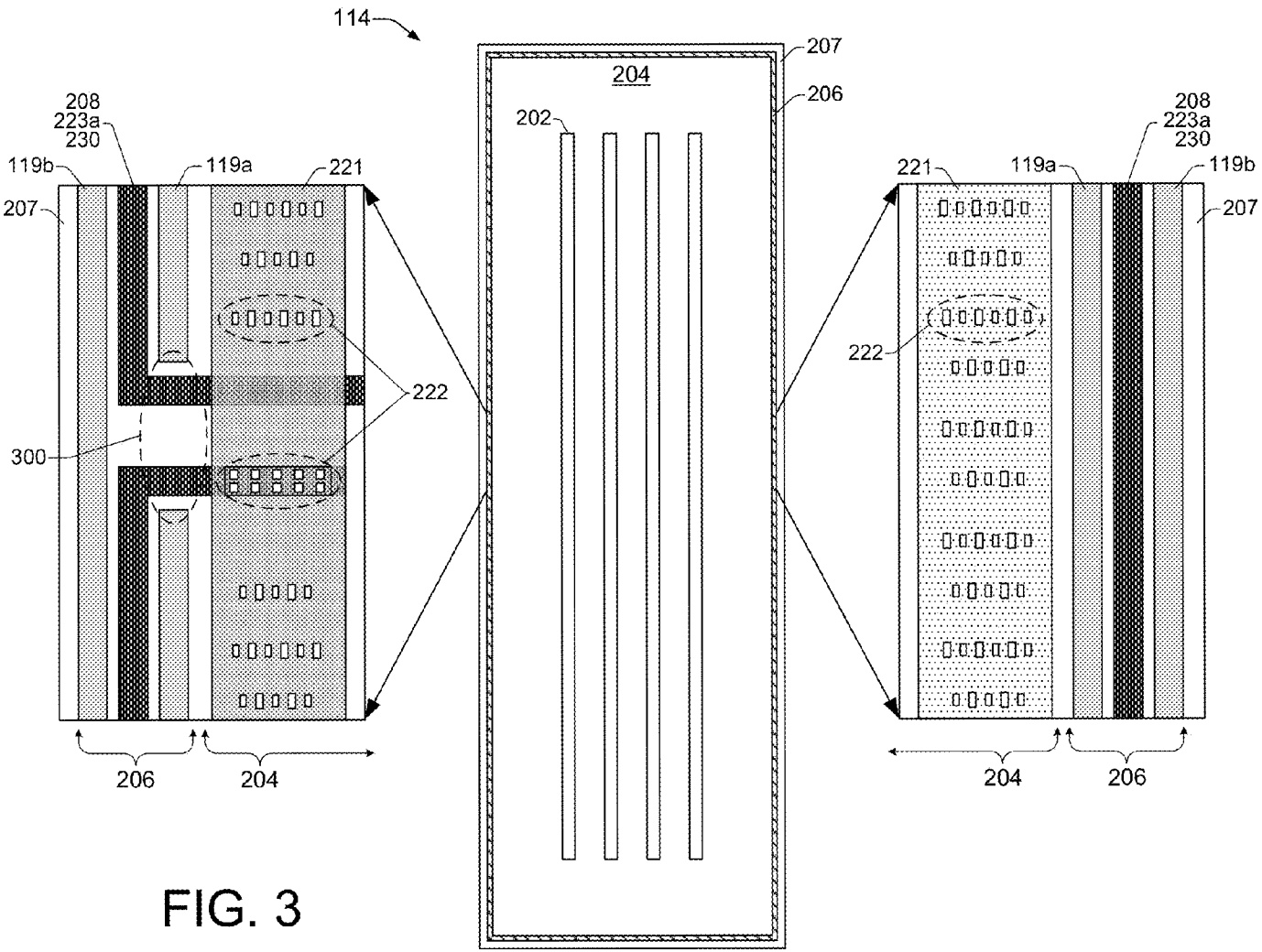
FIG. 3 shows a plan view of an example printhead die, according to an example implementation.

The printhead die 114 can be characterized in part as including a functional area 204 and a frame area 206. As shown in FIG. 2, the functional area 204 is an interior area of the die 114 surrounded by the frame area 206. Outside of the frame area 206, a portion of the saw street 207 typically remains after the die 114 has been cut away from the wafer. However, for the purposes of this disclosure, the edges and perimeter of the printhead die 114 are considered to be where the frame area 206 ends, or where it meets the saw street 207. The interior functional area 204, the frame area 206, and the remaining portion of the saw street 207 of the die 114 can be more readily observed in the plan view of an example printhead die 114, as shown in FIG. 3. The interior functional area 204 of the die 114 is generally defined by a dielectric layer 208 deposited onto the substrate 200. In addition to having the deposited dielectric layer 208, the interior functional area 204 of the die 114 includes various functional features that participate more directly in the ejection of fluid ink drops from the die. These functional features include the fluid slot 202 and drop generators 210. Each drop generator 210 includes a nozzle 116, an ink chamber 212, and a thermal firing resistor 214 that ejects ink drops through the nozzle116 by heating a small layer of fluid surrounding the resistor within the chamber 212, which creates a vapor bubble that forces ink out of the nozzle 116.

The dielectric layer 208 is a patterned thin-film layer comprising two materials deposited on top of the substrate 200. The first material of the dielectric layer 208 deposited onto the substrate 200 is silicon oxide ($SiO_2$) formed by chemical vapor deposition (CVD) with the precursor TEOS (tetraethyl orthosilicate). The second material in the dielectric layer 208 is $SiO_2$ formed by CVD with the precursor BPSG (borophosphosilicate glass) which is deposited on the TEOS layer. Other materials may also be suitable for the dielectric layer 208, such as undoped silicate glass (USG), silicon carbide or silicon nitride. Together, the TEOS and BPSG form the dielectric layer 208, which provides electrical insulation to prevent electrical shorting. The thickness of the dielectric layer 208 is on the order of between 0.5 and 2.0 microns. In general, the thickness and thermal conductivity and diffusivity properties of dielectric layer 208 provide electrical isolation of circuits relative to the substrate.

The functional area 204 of the printhead die 114 includes a resistive layer 216 deposited on top of dielectric layer 208. Thermal resistors 214 are formed in the resistive layer 216. The resistive layer can be formed of different materials including tungsten silicide nitride (WSiN), tantalum silicide nitride (TaSiN), tantalum aluminum (TaAl), tantalum nitride ($Ta_2N$), or combinations thereof. The resistive layer is typically on the order of between 0.025 and 0.2 microns thick.

A conductive metal layer 218 is deposited on top of the resistive layer 216 and can be used to provide current to the thermal resistor 214, and/or to couple the thermal resistor 214 to a control circuit or other electronic circuits on the printhead die 114. In other implementations the conductive layer 218 can be located underneath the resistive layer 216 to provide current to the thermal resistor 214. The conductive metal layer 218 can include materials such as platinum (Pt), aluminum (Al), tungsten (W), titanium (Ti), molybdenum (Mo), palladium (Pd), tantalum (Ta), nickel (Ni), copper (Cu) with an inserted diffusion barrier, and combinations thereof.

Another dielectric and/or passivation layer 220 can be deposited on the conductive metal layer 218 and can extend down through a via in the conductive metal layer 218 to the resistive layer 216, as shown in FIG. 2. The passivation layer 220 can function as a dielectric and as a cavitation barrier that protects the underlying circuits and layers from oxidation, corrosion, and other environmental conditions, such as the impact from collapsing vapor bubbles inside the chamber 212. The passivation layer 220 can be formed of materials such as silicon carbide (SiC), silicide nitride (SiN), TEOS, and combinations thereof.

The functional area 204 of the printhead die 114 includes a metal layer ground line 221 deposited on top of dielectric layer 208 around the perimeter of the functional area 204. The ground line 221 is used to couple various electronic components and conductors to ground through vias or contacts 222, such as a damage detection conductor 223 (i.e., 223*a* in FIG. 2). The ground line 221 can include materials such as platinum (Pt), aluminum (Al), tungsten (W), titanium (Ti), molybdenum (Mo), palladium (Pd), tantalum (Ta), nickel (Ni), copper (Cu) with an inserted diffusion barrier, and combinations thereof.

Also within the functional area of printhead die 114, chambers 212 are defined by a chamber layer 224 formed over the various underlying layers (e.g., passivation layer 220, conductive metal layer 218, resistive layer 216, dielectric layer 208) and the substrate 200. As shown in FIG. 2, the chamber layer 224 also defines a fluidic channel 225 (and other fluidic channels, not shown) which is the primary flow path for ink flowing into the chambers 212 from the fluid slot 202. The chamber layer 224 is typically formed of SU8 epoxy, but can also be made of other materials such as a polyimide.

A tophat layer or nozzle layer 226, is formed over the chamber layer 224 and includes nozzles 116 that each correspond with a respective chamber 212 and thermal resistor 214. The nozzle layer 226 forms a top over the slot 202 and other fluidic features of the chamber layer 224 (e.g., fluidic channels 225, and chambers 212). The nozzle layer 226 is typically formed of SU8 epoxy, but it can also be made of other materials such as a polyimide.

As shown in FIGS. 2 and 3, the frame area 206 of printhead die 114 is an exterior area of the die substrate that extends from the edges of the functional area 204 outward to the perimeter, or edges of the die 114. As noted above, while a portion of the saw street 207 typically remains around the die 114 after it has been cut away from the wafer, for the purposes of this disclosure the edges and perimeter of the printhead die 114 are considered to be where the frame area 206 ends, or where it meets the saw street 207. Thus, the frame area 206 surrounds the interior functional area 204 and extends from the outside edges of the die inward, until it contacts or meets with the interior functional area 204. The frame area 206 does not include functional features that participate directly with the process of ejecting fluid ink drops from the die 114. Instead, as noted above, the frame area 206 includes multiple termination rings 119 surrounding the functional interior area 204 of the die that help prevent kerf chips from propagating into the functional interior area. The termination rings 119 thus protect the die from attack at its edges by corrosive inks.

The frame area 206 is generally defined by a layer of silicon dioxide (SiO2) that is grown into the surface of the silicon substrate 200. The grown SiO2 layer 228 can be referred to as a field oxide layer, or FOX layer. A grown SiO2 layer is a relatively thick oxide (e.g., 100-500 nm) formed to passivate and protect the substrate 200. The grown SiO2 layer 228 covers the whole substrate surface within the frame area 206, which is outside of the active or functional area 204 device area. The SiO2 layer 228 therefore does not typically participate in the normal operation of the printhead die (i.e., fluid ejection, etc.). Because the SiO2 layer 228 is a grown oxide layer, rather than a deposited layer (e.g., by CVD, chemical vapor deposition), it provides greater integrity and higher strength to the substrate 200 which helps prevent kerf chips from propagating through the substrate 200 as deeper cracks.

Figure 4:
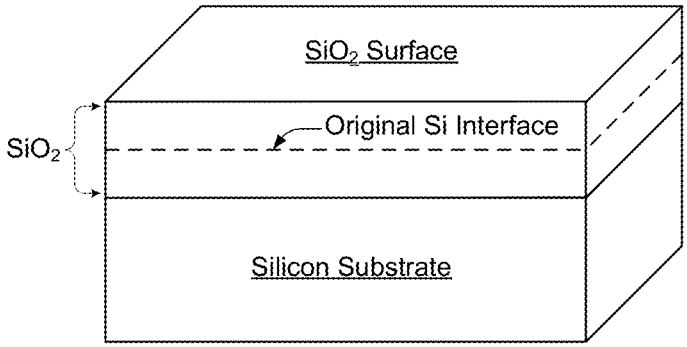
FIG. 4 shows a perspective view of an example portion of a silicon substrate that includes a grown SiO2 layer, according to an example implementation.

FIG. 4 shows a perspective view of a portion of a silicon substrate that includes a grown SiO2 layer 228, according to an example implementation. When the SiO2 layer is grown on a silicon substrate (e.g., in a diffusion furnace using a wet or dry growth method), oxidation reactions occurring at the Si/SiO2 interface consume the silicon, which moves the interface into the silicon substrate such that the SiO2 layer penetrates the surface of the silicon substrate. Referring again to FIG. 2, it is apparent that the SiO2 layer 228 has undergone such a growth process into the surface of the silicon substrate 200.

Referring again generally to FIGS. 2 and 3, within the frame area 206 of printhead die 114, a first termination ring 119*a* is located adjacent to and surrounding the functional interior area 204 of the die 114. The first termination ring 119*a* is concentric around the functional interior area 204, and is defined by an area of the grown SiO2 layer 228 and an absence of the dielectric layer 208 over a portion of the grown SiO2 layer. That is, the dielectric layer 208 has been removed from over the grown SiO2 layer 228 in the area of the first termination ring 119*a*. Covering the SiO2 layer in the area of the first termination ring 119*a* is the passivation layer 220, or second dielectric layer.

A berm 230 located within the frame area 206 of printhead die 114 is adjacent to and surrounds the first termination ring 119*a*. The berm is concentric around the first termination ring 119*a*, and is defined by the presence of the dielectric layer 208 over an area of the grown SiO2 layer 228 within the berm area. That is, a portion of the dielectric layer 208 (including a layer of TEOS and BPSG), remains deposited over the grown SiO2 layer 228 within the area of the berm 230.

Located within the frame area 206 between the berm 230 and the grown SiO2 layer 228, is a damage detection conductor 223 (i.e., 223*a* in FIGS. 2 and 3). That is, the damage detection conductor 223 is deposited on the grown SiO2 layer 228 underneath the berm 230. Thus, like the berm 230, the damage detection conductor 223 is adjacent to and surrounds the first termination ring 119*a*. The damage detection conductor 223 can be formed of any brittle conductor such as polysilicon or tungsten silicide nitride (WSiN). Other materials that may be suitable to form a damage detection conductor 223 include, for example, tantalum silicide nitride (TaSiN), tantalum aluminum (TaAl), tantalum nitride (Ta2N), platinum (Pt), aluminum (Al), tungsten (W), titanium (Ti), molybdenum (Mo), palladium (Pd), tantalum (Ta), nickel (Ni), copper (Cu) with an inserted diffusion barrier, and combinations thereof.

A second termination ring 119*b* is located within the frame area 206 of printhead die 114, adjacent to and surrounding the berm 230 and underlying damage detection conductor 223. The second termination ring 119*b* is concentric around the functional interior area 204, and is defined by an area of the grown SiO2 layer 228 and an absence of the dielectric layer 208 over a portion of the SiO2 layer. That is, the dielectric layer 208 has been removed from over the grown SiO2 layer 228 in the area of the second termination ring 119*b*. Covering the grown SiO2 layer 228 in the area of the second termination ring 119*b* is the passivation layer 220, or second dielectric layer.

Break lines 232 are defined within the frame area 206 at the intersections or borders in areas of the grown SiO2 layer 228 that are with, and without, coverage by the BPSG and TEOS of the dielectric layer 208. The break lines 232 act as barriers to kerf chip propagation. In general, there are kerf chip barriers 232 present wherever there are transitions between areas that have the BPSG and TEOS dielectric layer 208 and areas that do not have the BPSG and TEOS of the dielectric layer 208. Thus, there are kerf chip barriers 232 present on either side of the berm 230 where the berm 230 borders the two termination rings 119. In addition, because the saw street 207 has a portion of the dielectric layer 208 remaining, there is also a kerf chip barrier 232 at the edge of the substrate die where the frame area 206 and second termination ring 119*b* border the saw street 207.

As shown in FIG. 3, there is an area of discontinuity 300 in the first termination ring 119*a*. Thus, while the first termination ring 119*a* surrounds the functional interior area 204 of the die 114, the discontinuity 300 provides a space through which ends of the damage detection conductor 223*a* can pass in order to connect with other circuitry and the ground line 221. More specifically, referring to both FIGS. 3 and 5, the damage detection conductor 223*a* traverses the perimeter of the die 114 outside the first termination ring 119*a* but within the second termination ring 119*b*, and its ends pass through the discontinuity 300 in the first termination ring 119*a*. A first end of the damage detection conductor 223*a* is coupled to the ground line 221 through vias 222, and a second end is coupled to a switch circuit 400*a*. Switch circuits 400 are controllable by damage detect module 134 executing on processor 128 to apply a voltage (+V) to the second ends of damage detection conductors 223. Processor 128 can then measure the resistance 402*a* across the conductor 223*a* and determine if there is a break in the conductor 223*a*. If the processor 128 measures an open circuit (i.e., an infinite or near infinite resistance value), it determines that there is a break somewhere in the damage detection conductor 223*a* and provides an indication (e.g., a message output to a user interface of the printing system 100) that the die has been damaged.

Figure 5:
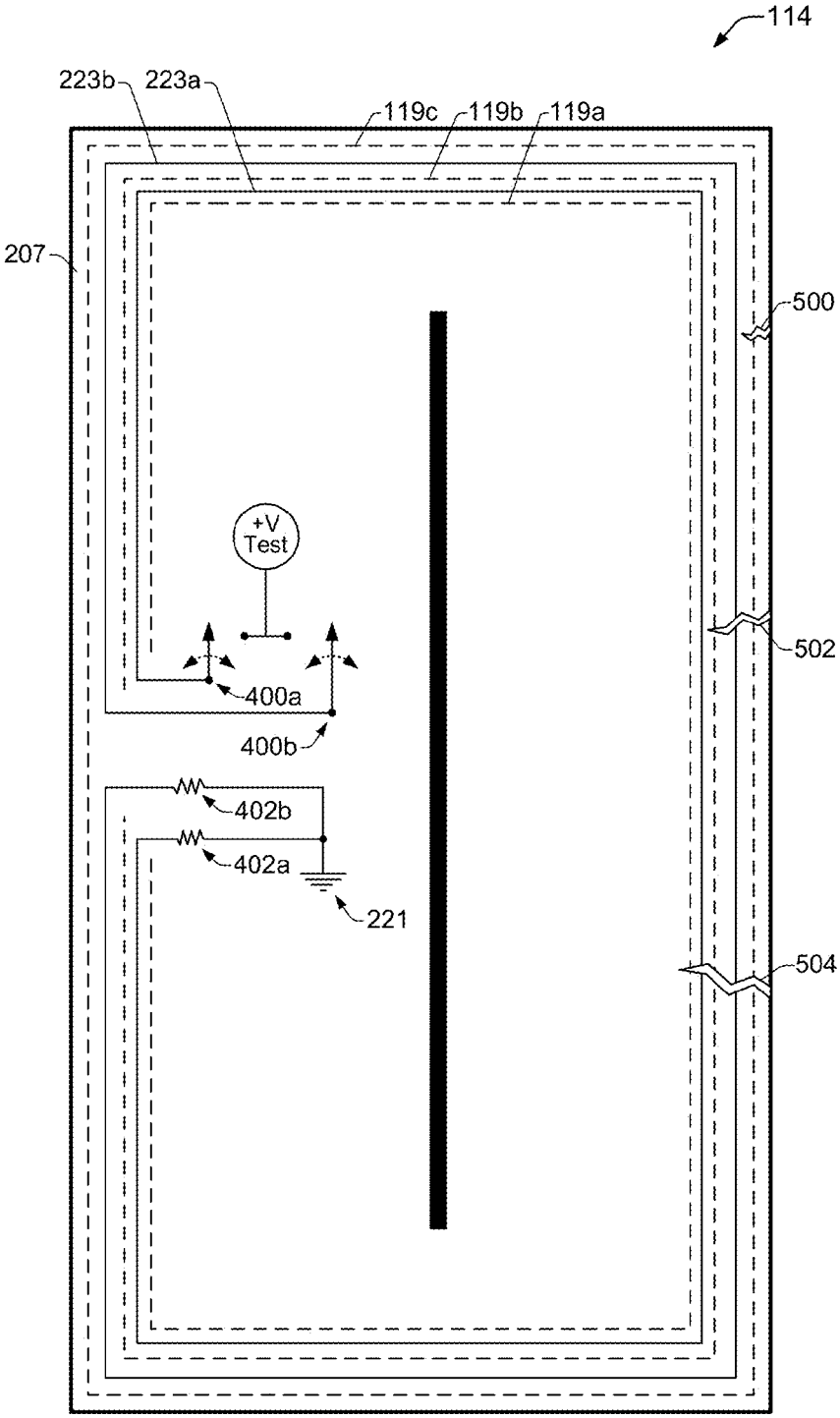
FIGS. 5 and 6 show plan views of an example printhead die, according to an example implementation.
Figure 6:
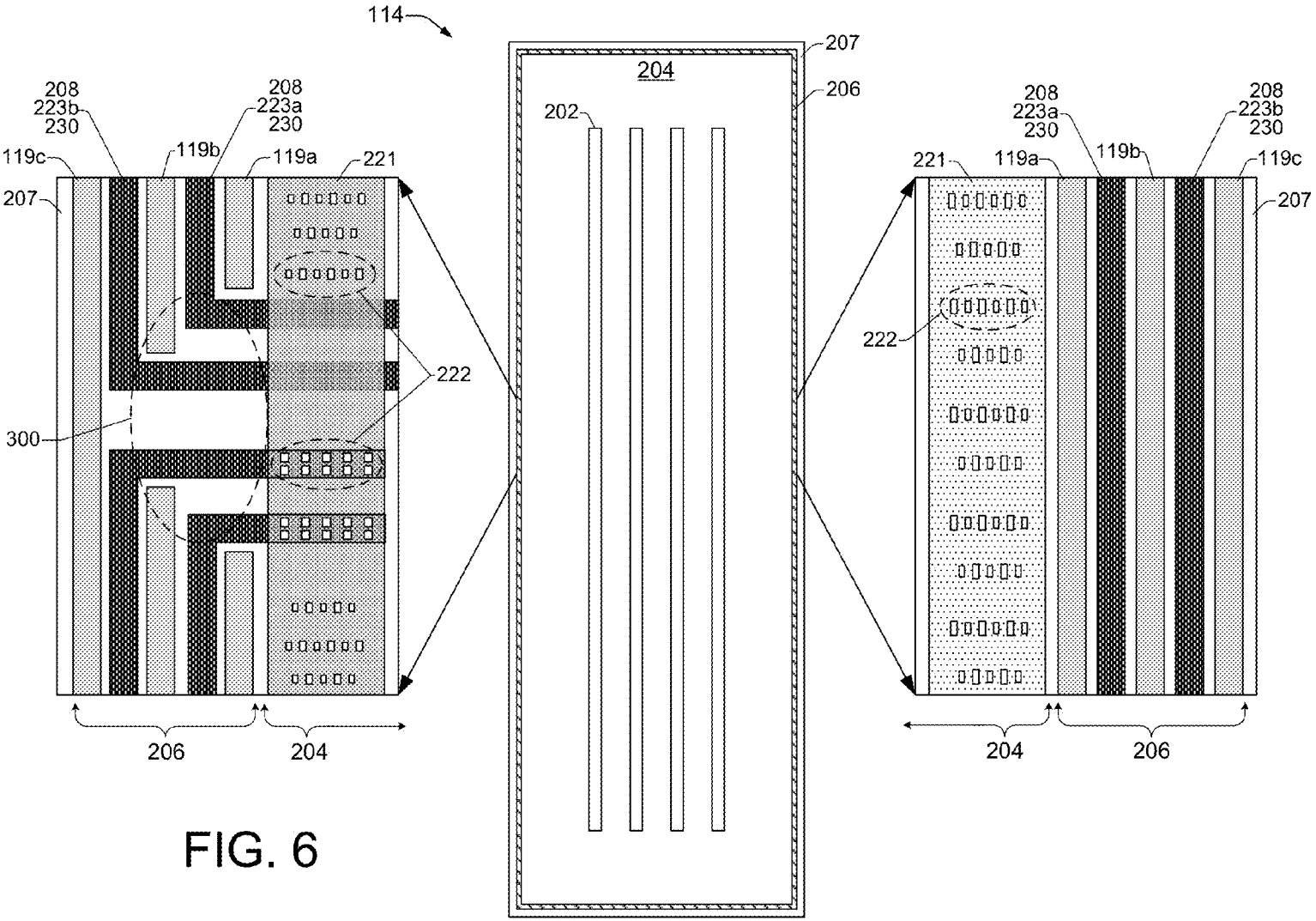

As noted above, additional termination rings can be formed concentrically around the second termination ring 119*b*, with berms 230 and underlying damage detection conductors 223 between each set of two rings. Thus, as shown in FIGS. 5 and 6, a third termination ring 119*c* is included around the perimeter of the die 114, and a second berm 230 and corresponding damage detection conductor 223*b* are between the third termination ring 119*c* and the second termination ring 119*b*. The multiple damage detection conductors 223*a* and 223*b* between concentric termination rings enable the damage detect module 134 executing on processor 128 to gather and report graduated damage data that indicates different levels of damage to the printhead die 114. The graduated damage data enables the processor 128 to report useful information that can help a user determine the likelihood of having to replace a printhead assembly 102.

For example, referring to FIG. 5, kerf chips may develop into cracks 500, 502, and 504, that propagate inward to different levels from the edges of die 114 toward the interior functional area of the die 114. Execution of damage detect module 134 on processor 128 will first operate switch 402*b* to apply a voltage to damage detection conductor 223*b* and determine if the resistance 402*b* in the conductor 223*b* indicates a break (i.e., and open circuit) in conductor 223*b*. As shown in FIG. 5, although crack 500 propagates through the outermost, third termination ring 119*c*, it does not cause a break in damage detect conductor 223*b*. Therefore, if crack 500 is the only kerf chip damage present (i.e., cracks 502 and 504 are not present), the processor 128 will gather and report on data indicating that there is no damage to the die 114 that exceeds a first level. An example report on such data might simply indicate that no damage is detected on the printhead die 114.

However, crack 502 has propagated past both the outermost, third termination ring 119*c*, the damage detect conductor 223*b*, and the second termination ring 119*b*. Therefore, a test of the resistance 402*b* in conductor 223*b* will reveal an open circuit, and result in data indicating that kerf chip damage has progressed through the conductor 223*b*. Therefore, the processor 128 will gather and report on data indicating that there is damage to the die 114 past a first level. The continued execution of damage detect module 134 on processor 128 will operate switch 402*a* to apply a voltage to damage detection conductor 223*a* and determine if the resistance 402*a* in the conductor 223*a* indicates a break (i.e., and open circuit) in conductor 223*a*. Because crack 502 has not propagated past conductor 223*a*, the processor 128 will gather and report on data indicating that damage to the die 114 does not exceed a second level. An example report on the data gathered from both conductors 223*b* and 223*a* might indicate that some damage is detected on the printhead die 114, but that the die 114 is not defective.

As shown in FIG. 5, crack 504 has propagated past the outermost, third termination ring 119*c*, the damage detect conductor 223*b*, the second termination ring 119*b*, the damage detect conductor 223*a*, and the first termination ring 119*a*. Therefore, tests of the resistance 402*b* in conductor 223*b* and the resistance 402*a* in conductor 223*a* will both reveal open circuits. This will result in processor 128 gathering and reporting on data indicating that there is damage to the die 114 that exceeds a second level. An example report on the data gathered from both conductors 223*b* and 223*a* might indicate that damage is detected on the printhead die 114 and that the damage may have penetrated the functional area of the die, causing the die to be defective.

In addition to including alternate implementations in which multiple termination rings 119, berms 230, and damage detection conductors 223 are present within the frame area 206 of a printhead die 114, this disclosure also contemplates and includes additional configurations of a layered architecture. For example, FIGS. 7-11 illustrate a number of printhead die configurations in which the layered architectures vary from that shown in FIG. 2, according to different example implementations. In general, the printhead die configurations shown in FIGS. 7-11 include variations from the FIG. 2 configuration in which the underlying SiO2 layer 228 is grown into the substrate 200 over different areas of the substrate surface, and in some cases, where such grown SiO2 layer 228 has been removed.

Figure 7:
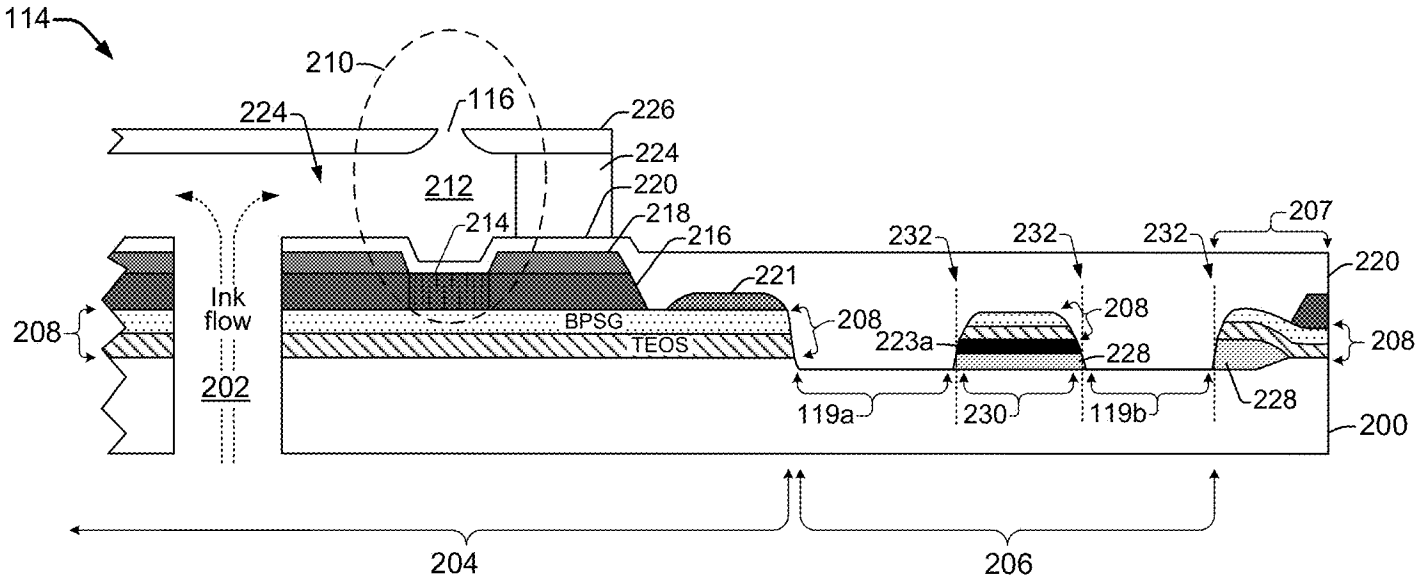
FIGS. 7-11 show varying printhead die configurations in which layered architectures vary from one to another, according to different example implementations.
Figure 8:
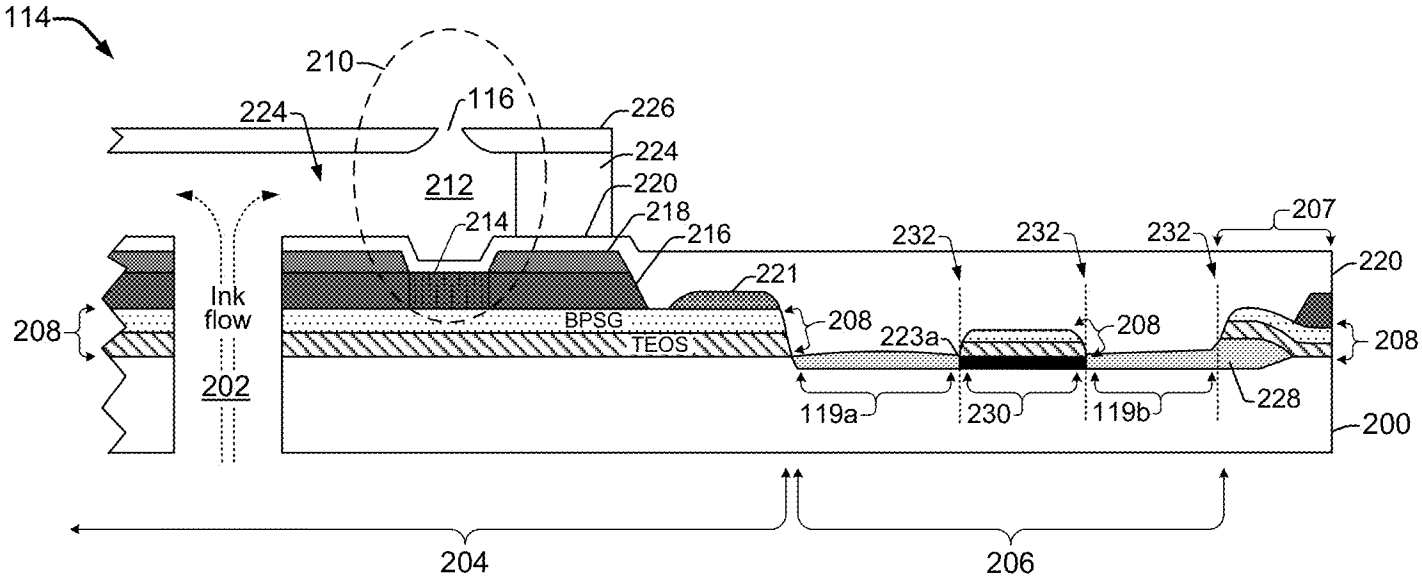
Figure 9:
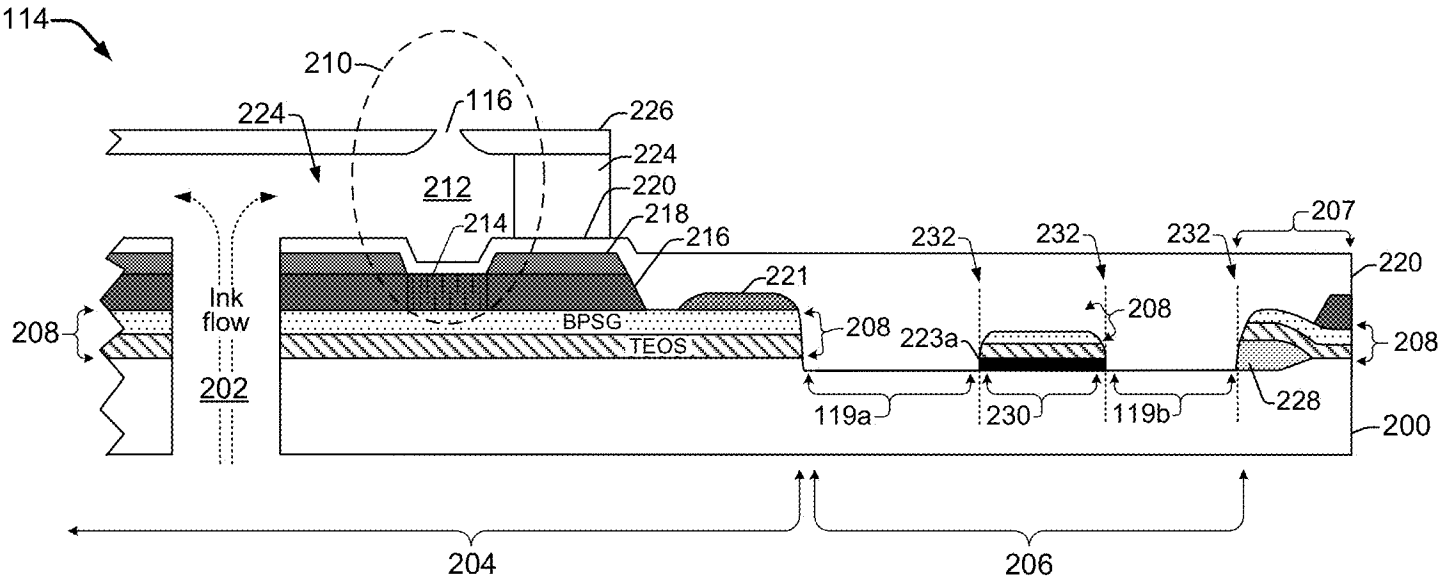
Figure 10:
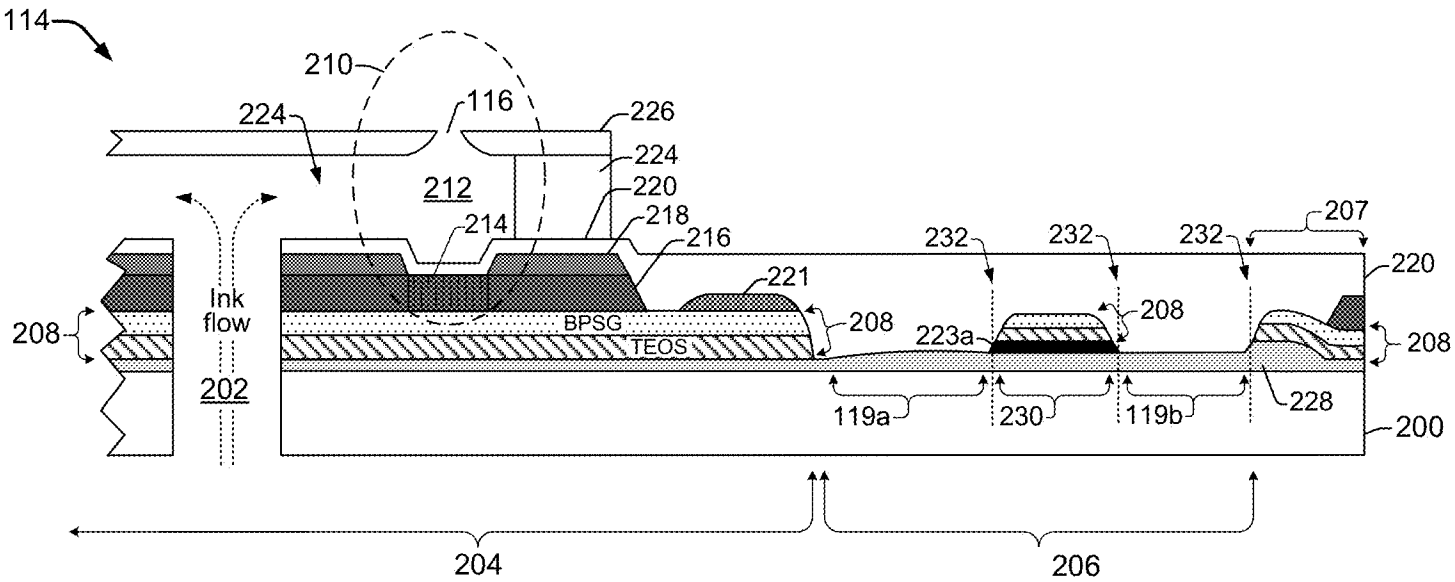
Figure 11:
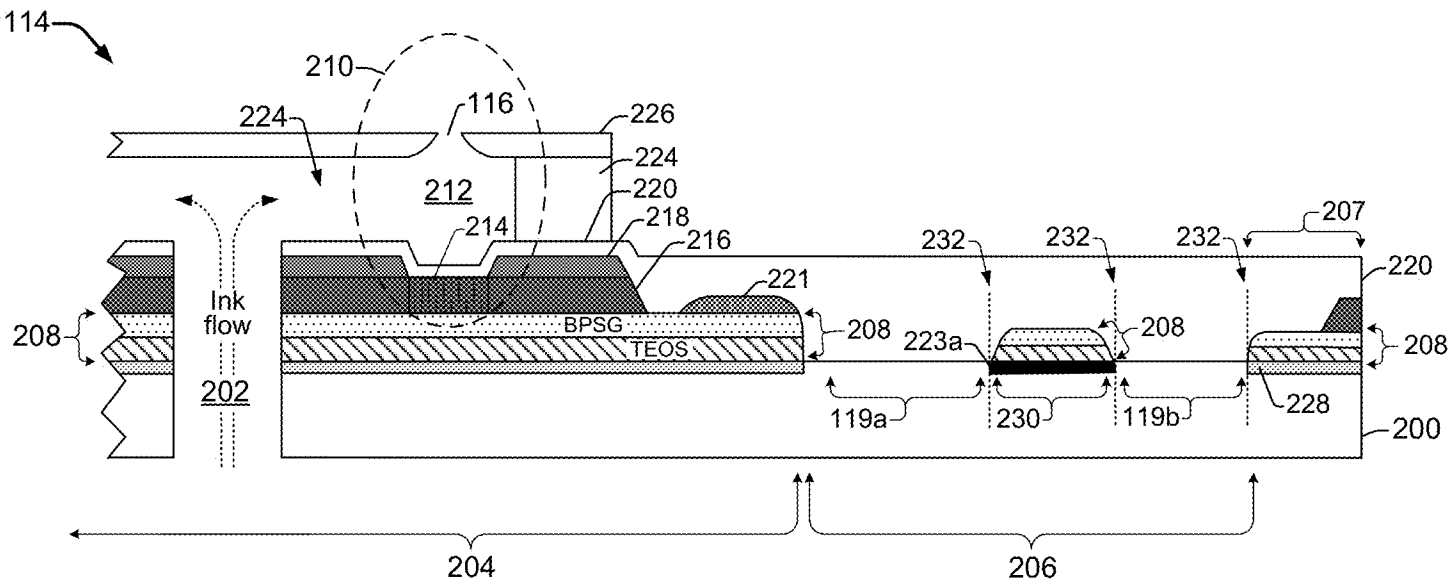

As noted above, the layered architecture of the printhead die 114 shown in FIG. 2 includes a layer of silicon dioxide (SiO2) that is grown into the surface of the silicon substrate 200 over the frame area 206. FIG. 7 shows another example of a printhead die 114 in which the grown SiO2 layer 228 shown in FIG. 2 has been fully removed from the areas of the first termination ring 119*a* and the second termination ring 119*b* within the frame area 206. Thus, in this example, the SiO2 layer was grown into the substrate over the frame are 206 and then removed from particular locations. FIG. 8 shows an example of a printhead die 114 in which the SiO2 layer 228 is grown within the frame area 206, except in the area of the berm 230. Thus, there is grown SiO2 228 underlying both the first and second termination rings 119, but there is no grown SiO2 underlying the berm 230. In this implementation, the damage detect conductor 223*a* is deposited directly onto the substrate 200, or it may be implanted by doping the silicon substrate (e.g., with boron or phosphorous). FIG. 9 shows an example of a printhead die 114 in which the SiO2 layer 228 is grown within the frame area 206 underlying the first and second termination rings 119, and then removed from these areas. In this example, the SiO2 layer 228 is not grown in the area of the berm 230. Thus, as shown in FIG. 9, there is no SiO2 layer 228 underlying the first and second termination rings 119 or the berm 230. In this implementation, the damage detect conductor 223*a* is deposited directly onto the substrate 200, or it may be implanted by doping the silicon substrate. FIG. 10 shows an example of a printhead die 114 in which the SiO2 layer 228 is grown into the substrate 200 over the entire surface area of the substrate. Thus, in this example, the grown SiO2 layer 228 underlies the termination rings 119 and berm 230 within the frame area 206, the saw street 207 area, and the interior functional area 204 of the die 114. FIG. 11 shows an example of a printhead die 114 in which the SiO2 layer 228 is grown within the interior functional area 204 and the saw street 207 area of the die 114, but not within the frame area 206 of the die 114. Thus, in this example the grown SiO2 layer 228 is not underlying the termination rings 119 or the berm 230, and is generally located on the die surface in a manner that is opposite to that shown in FIG. 2. In this implementation, the damage detect conductor 223*a* is deposited directly onto the substrate 200, or it may be implanted by doping the silicon substrate.

Figure 12:
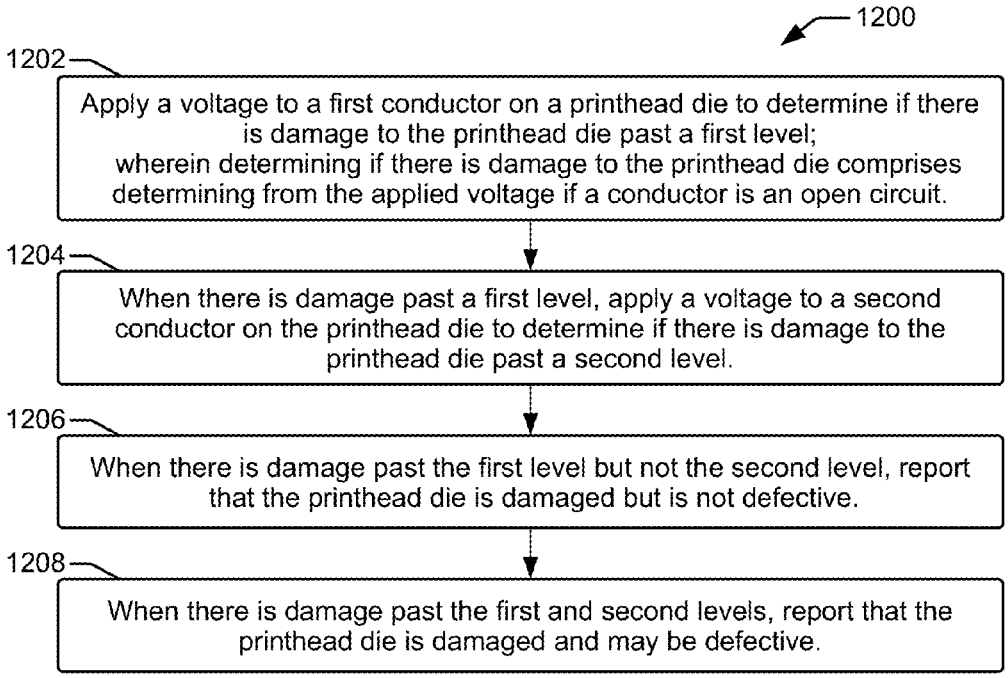
FIG. 12 shows a flowchart of an example method related to detecting kerf chip damage to a printhead die, according to an example implementation.

FIG. 12 shows a flowchart of an example method 1200, related to detecting kerf chip damage to a printhead die, according to an example implementation. Method 1200 is associated with the example implementations discussed above with regard to FIGS. 1-11, and details of the steps shown in method 1200 can be found in the related discussion of such implementations. The steps of method 1200 may be embodied as programming instructions stored on a non-transitory computer/processor-readable medium, such as memory 130 of FIG. 1*a*. In one example, implementing the steps of method 1200 is achieved by the reading and execution of such programming instructions by a processor, such as processor 128 of FIG. 1*a*. Method 1200 may include more than one implementation, and different implementations of method 1200 may not employ every step presented in the flowchart of FIG. 12. Therefore, while steps of method 1200 are presented in a particular order within the flowchart, the order of their presentation is not intended to be a limitation as to the order in which the steps may actually be implemented, or as to whether all of the steps may be implemented. For example, one implementation of method 1200 might be achieved through the performance of a number of initial steps, without performing one or more subsequent steps, while another implementation of method 1200 might be achieved through the performance of all of the steps.

Referring to FIG. 12, method 1200 begins at block 1202, with applying a voltage to a first conductor on a printhead die to determine if there is damage to the printhead die past a first level. In this implementation, the first conductor is a conductor on the outermost perimeter of the printhead die. Determining if there is damage to the printhead die comprises determining from the applied voltage if a conductor is an open circuit. This determination can include measuring the resistance across the first conductor and/or measuring the current passing through the first conductor. When there is damage past the first level, voltage is applied to a second conductor on the printhead die to determine if there is damage to the printhead die past a second level, as shown at block 1204. As shown at block 1206, when there is damage past the first level but not the second level, a report is made that the printhead die is damaged but is not defective. When there is damage past the first and second levels, a report is made that the printhead die is damaged and may be defective, as shown at block 1208 of method 1200.

What is claimed is:

1. A printhead die comprising:

a SiO2 layer grown into a surface of a silicon substrate;

a dielectric layer formed on the surface over an interior area of the substrate;

a first termination ring surrounding the interior area and defined by an absence of the dielectric layer;

a berm surrounding the first termination ring and defined by the presence of the dielectric layer;

a damage detection conductor formed under the berm on the SiO2 layer; and, a second termination ring surrounding the berm and defined by an absence of the dielectric layer.

2. A printhead die as in claim 1, further comprising:

a ground trace surrounding the interior area and surrounded by the first termination ring.

3. A printhead die as in claim 2, further comprising:

an opening in the first termination ring through which first and second ends of the damage detection conductor extend;

a switch coupled to the first end of the damage detection conductor; and a via coupling the second end of the damage detection conductor with the ground trace.

4. A printhead die as in claim 1, wherein the SiO2 layer covers a frame area of the substrate that surrounds the interior area and extends from the interior area to edges of the substrate, such that the SiO2 layer underlies the termination rings, the berm, and the damage detection conductor.

5. A printhead die as in claim 4, wherein the SiO2 layer has been removed from under the termination rings.

6. A printhead die as in claim 4, wherein the SiO2 layer has been removed from under the berm.

7. A printhead die as in claim 4, wherein the SiO2 layer covers part of the frame area, such that the SiO2 layer underlies the termination rings but does not underlie the berm.

8. A printhead die as in claim 1 wherein the SiO2 layer covers the interior area of the substrate and a saw street area surrounding the second termination ring, but does not cover a frame area of the substrate underlying the termination rings and the berm.

9. A printhead die as in claim 1, wherein the dielectric layer comprises a thin-film layer of TEOS deposited on the surface and BPSG deposited on the TEOS.

10. A printhead die as in claim 1, further comprising kerf chip barriers at borders between the berm and the termination rings.

11. A printhead die as in claim 10, wherein a kerf chip barrier comprises an intersection between a presence of the dielectric layer and an absence of the dielectric layer.

12. A printhead die as in claim 1, further comprising:

a portion of a saw street bordering the second termination ring; and a kerf chip barrier at the border between the second termination ring and the saw street.

13. A printhead die as in claim 1, further comprising:

a fluid slot formed in the substrate; and a drop generator formed on the substrate to eject fluid drops.

14. A printhead die as in claim 13, wherein the drop generator comprises:

a thermal resistor formed in a resistive layer;

a fluidic chamber defined by a chamber layer; and a nozzle defined by a nozzle layer.

15. The non-transitory processor-readable medium of claim 1, wherein determining if there is damage to the printhead die comprises determining from the applied voltage if a conductor is an open circuit.

16. A printhead die comprising:

a SiO2 layer grown into a surface of a silicon substrate;

a dielectric layer deposited onto an interior surface area of the substrate;

multiple termination rings formed concentrically around the interior surface area, each ring defined by an absence of the dielectric layer;

a berm in between every set of two termination rings, each berm defined by the presence of the dielectric layer; and a damage detection conductor formed on the SiO2 layer under each berm.

17. A non-transitory processor-readable medium storing code representing instructions that when executed by a processor cause the processor to:

apply a voltage to a first conductor on a printhead die to determine if there is damage to the printhead die past a first level;

when there is damage past a first level, apply a voltage to a second conductor on the printhead die to determine if there is damage to the printhead die past a second level;

when there is damage past the first level but not the second level, report that the printhead die is damaged but is not defective; and when there is damage past the first and second levels, report that the printhead die is damaged and may be defective.

* * * * *